US009425509B2

(12) United States Patent
Liou et al.

(10) Patent No.: US 9,425,509 B2
(45) Date of Patent: Aug. 23, 2016

(54) ANTENNA STRUCTURE AND WIRELESS COMMUNICATION DEVICE USING THE SAME

(71) Applicant: Chiun Mai Communication Systems, Inc., New Taipei (TW)

(72) Inventors: Geng-Hong Liou, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 157 days.

(21) Appl. No.: 14/224,848

(22) Filed: Mar. 25, 2014

(65) Prior Publication Data

US 2015/0002340 A1 Jan. 1, 2015

(30) Foreign Application Priority Data

Jun. 27, 2013 (TW) ..... 102122950

(51) Int. Cl.

| | |
|---|---|
| ***H01Q 1/24*** | (2006.01) |
| ***H01Q 5/00*** | (2015.01) |
| ***H01Q 7/00*** | (2006.01) |
| ***H01Q 9/42*** | (2006.01) |
| *H01Q 19/00* | (2006.01) |

(52) U.S. Cl.

CPC ..... *H01Q 5/0062* (2013.01); *H01Q 7/00* (2013.01); *H01Q 9/42* (2013.01)

(58) Field of Classification Search

CPC ..... H01Q 1/243; H01Q 9/42; H01Q 11/14; H01Q 11/16; H01Q 11/18; H01Q 19/00; H01Q 1/24; H01Q 5/371; H01Q 5/50; H01Q 5/392; H01Q 1/392

USPC ..... 343/702

See application file for complete search history.

(56) References Cited

U.S. PATENT DOCUMENTS

| | | | | |
|---|---|---|---|---|
| 6,476,769 | B1 * | 11/2002 | Lehtola | H01Q 1/243 343/700 MS |
| 7,525,492 | B2 * | 4/2009 | Yu | H01Q 9/42 343/700 MS |
| 8,373,600 | B2 * | 2/2013 | Chang | H01Q 1/243 343/700 MS |
| 8,552,919 | B2 * | 10/2013 | Hsieh | H01Q 1/243 343/722 |
| 2001/0050643 | A1 * | 12/2001 | Egorov | H01Q 1/243 343/702 |
| 2003/0052824 | A1 * | 3/2003 | Ollikainen | H01Q 1/243 343/700 MS |
| 2004/0233109 | A1 * | 11/2004 | Ying | H01Q 1/243 343/700 MS |
| 2006/0061509 | A1 * | 3/2006 | Chen | H01Q 1/243 343/700 MS |
| 2009/0073048 | A1 * | 3/2009 | Kim | H01Q 1/243 343/700 MS |
| 2010/0277378 | A1 * | 11/2010 | Shimizu | H01Q 1/243 343/702 |

(Continued)

*Primary Examiner* — Dameon E Levi
*Assistant Examiner* — Awat Salih
(74) *Attorney, Agent, or Firm* — ScienBiziP, P.C.

(57) ABSTRACT

An antenna structure includes a feed portion, a first ground portion, a second ground portion, a first antenna, and a second antenna. The first antenna includes a first radiator and a second radiator. The second antenna includes a first radiation portion, a second radiation portion, a third radiation portion, and a fourth radiation portion, the first radiation portion, the second radiation portion, the third radiation portion, and the fourth radiation portion are connected in turn to substantially form a loop structure. Both of the first radiator and the second radiator are connected to the feed portion, the first radiator is parallel to the first radiation portion, the second radiator is parallel to the second radiation portion, the first radiation portion is connected to the first ground portion, and the fourth radiation portion is connected to the second ground portion.

17 Claims, 2 Drawing Sheets

(56) References Cited

U.S. PATENT DOCUMENTS

2011/0140973 A1* 6/2011 Yamagajo ..... H01Q 1/36 343/702
2011/0187607 A1* 8/2011 Lu ..... H01Q 9/26 343/702
2012/0162022 A1* 6/2012 Wei ..... H01Q 5/371 343/700 MS
2012/0242555 A1* 9/2012 Hsieh ..... H01Q 1/243 343/833
2013/0234897 A1* 9/2013 Yoon ..... H01Q 19/00 343/700 MS

* cited by examiner

ANTENNA STRUCTURE AND WIRELESS COMMUNICATION DEVICE USING THE SAME

BACKGROUND

1. Technical Field

The disclosure generally relates to antenna structures, and particularly to an antenna structure for receiving/transmitting dual-band wireless signals or multiband wireless signals and a wireless communication device using the same.

2. Description of Related Art

Antennas are used in wireless communication devices such as mobile phones. The wireless communication device uses a multiband antenna to receive/transmit wireless signals at different frequencies. However, many multiband antennas have complicated structures and are large, thereby making it difficult to miniaturize the wireless communication devices.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
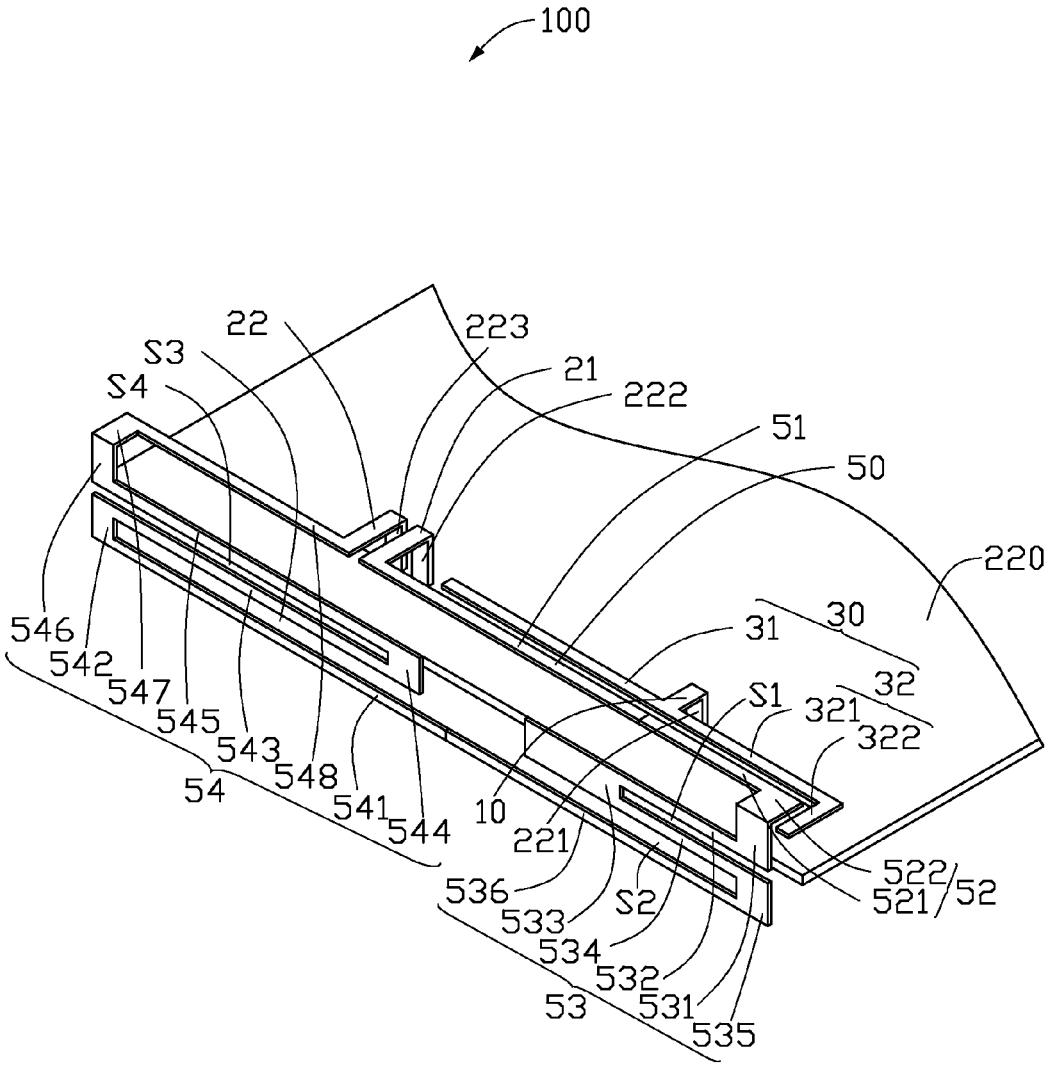
FIG. 1 is an isometric view of a wireless communication device employing an antenna structure, according to an exemplary embodiment.

FIG. 1 shows a wireless communication device 200 employing an antenna structure 100, according to an exemplary embodiment. The wireless communication device 200 can be a mobile phone or a personal digital assistant, for example.

The wireless communication device 200 includes a printed circuit board (PCB) 220. The PCB 220 has a feed pin 221, a first ground pin 222, and a second ground pin 223 formed on one surface of the PCB 220. The feed pin 221 is configured to provide current to the antenna structure 100. The antenna structure 100 is located above the PCB 220, and is grounded through the first ground pin 222 and the second ground pin 223.

The antenna structure 100 includes a feed portion 10, a first ground portion 21, a second ground portion 22, a first antenna 30, and a second antenna 50. The feed portion 10 is connected to the feed pin 221, the first ground portion 21 is parallel to the second ground portion 22, the first ground portion 21 is connected to the first ground pin 222, and the second ground portion 22 is connected to the second ground pin 223.

The first antenna 30 includes a first radiator 31 and a second radiator 32 substantially positioned coplanar with the first radiator 31. The first radiator 31 is a rectangular sheet. The first radiator 31 is connected to the feed portion 10, and extends towards the first ground portion 21. The second radiator 32 is a substantially bent L-shaped sheet, and includes a first extending sheet 321 and a second extending sheet 322. The first extending sheet 321 is connected to the feed portion 10, and extends away from the first radiator 31. The second extending sheet 322 is connected substantially perpendicularly to the first extending sheet 321.

The second antenna 50 is made of metal, and two distal ends of the second antenna 50 are connected to the first ground portion 21 and the second ground portion 22, respectively. The second antenna 50 includes a first radiation portion 51, a second radiation portion 52, a third radiation portion 53, and a fourth radiation portion 54. The first radiation portion 51 is connected to the first ground portion 21, the fourth radiation portion 54 is connected to the second ground portion 22, and the first radiation portion 51, the second radiation portion 52, the third radiation portion 53, and the fourth radiation portion 54 are connected in turn. Thus, the second antenna 50 substantially forms a loop structure.

The first radiation portion 51 is parallel to the first radiator 31, and a length of the first radiation portion 51 is greater than the first radiator 31. The second radiation portion 52 includes a first sheet 521 and a second sheet 522. The first sheet 521 is connected to the first radiation portion 51, and is parallel to the first extending sheet 321. The second sheet 522 is connected substantially perpendicularly to the first sheet 521, and is parallel to the second extending sheet 322.

The third radiation portion 53 is positioned on a plane that is substantially perpendicular to a plane in which the second radiation portion 52 is positioned. The third radiation portion 53 includes a first extending section 531, a second extending section 532, a third extending section 533, a fourth extending section 534, a fifth extending section 535, and a sixth extending section 536. The first extending section 531 is connected to the second sheet 522. The second extending section 532 is connected substantially perpendicularly to the first extending section 531. The third extending section 533 is a rectangular sheet, and is perpendicularly connected between the second extending section 532 and the fourth extending section 534. The fourth extending section 534 and the second extending section 532 are positioned parallel to each other and extend along two opposite directions to define a first gap S1. The fifth extending section 535 is perpendicularly connected between the fourth extending section 534 and the sixth extending section 536. The sixth extending section 536 and the fourth extending section 534 are positioned parallel to each other and extend along two opposite directions to define a second gap S2.

The fourth radiation portion 54 includes a first connection section 541, a second connection section 542, a third connection section 543, a fourth connection section 544, a fifth connection section 545, a sixth connection section 546, a seventh connection section 547, and a eighth connection section 548. The first connection section 541 is connected to the sixth extending section 536. The second connection section 542 is perpendicularly connected between the first connection section 541 and the third connection section 543, and is parallel to the fifth extending section 535. A third gap S3 is defined between the first connection section 541 and the third connection section 543. The fourth connection section 544 is perpendicularly connected between the third connection section 543 and the fifth connection section 545, and is opposite to the third extending section 533. The fifth connection section 545 and the third connection section 543 are positioned parallel to each other and extend along two opposite directions to define a fourth gap S4. The sixth connection section 546 is connected substantially perpendicularly to the fifth connection section 545, and is parallel to the third extending section 533. The seventh connection section 547 is connected substantially perpendicularly to the sixth connection section 546, and is substantially coplanar with the first radiation portion 51. The eighth connection section 548 extends towards the first radiation portion 51, and a distal end of the eight connection section 548 is connected to the second ground portion 22.

Figure 2:
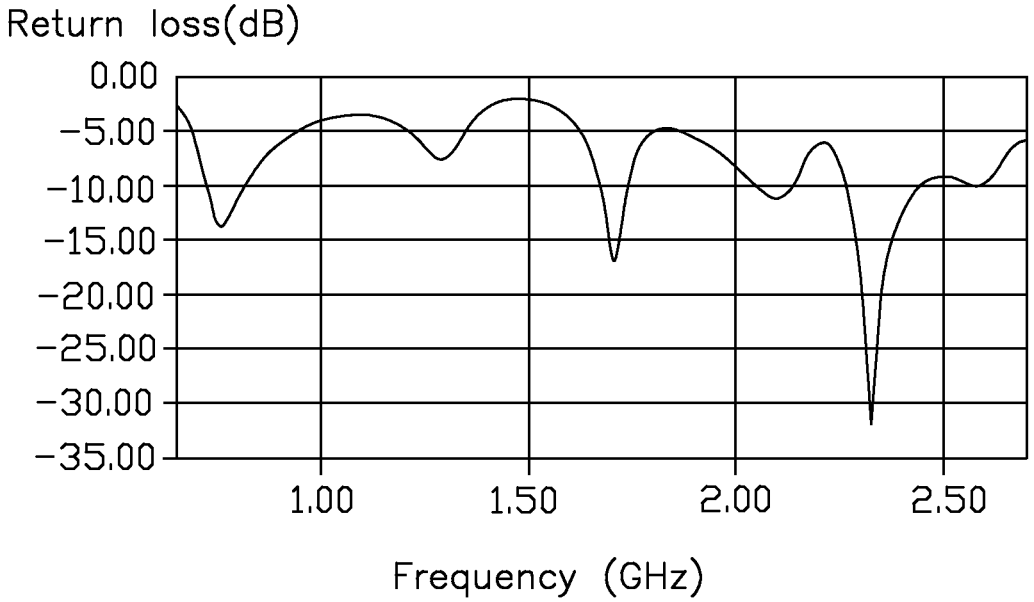
FIG. 2 is a return loss (RL) graph of the antenna structure of FIG. 1.

When current is input to the feed portion 10 from the feed pin 221, the current flows to the first radiator 31 and the second radiator 32. A first proportion of the current is coupled from the first radiator 31 to the first radiation portion 51, and is grounded via the first ground portion 21. Thus, the first radiator 31 and the first radiation portion 51 are activated to receive/transmit first wireless signals at a first central frequency of about 1710 MHz. A second proportion of the current is coupled from the second radiator 32 to the second antenna 50, and flows to the second radiation portion 52, the third radiation portion 53, and the fourth radiation portion 54. Thus, the second radiator 32, the second radiation portion 52, the third radiation portion 53, and the fourth radiation portion 54 are activated to receive/transmit second wireless signals at a second central frequency of about 800 MHz. A third proportion of the current is coupled from the second radiator 32 to the second radiation portion 52. Thus, the second radiator 32 and the second radiation portion 52 are activated to receive/transmit third wireless signals at a third central frequency of about 2650 MHz. In addition, the current is coupled from the second radiation portion 52 to the third radiation portion 53, and flows to the first extending section 531, the second extending section 532, the third extending section 533, the fourth extending section 534, the fifth extending section 535, and the sixth extending section 536. Thus, the third radiation portion 53 is activated to receive/transmit fourth wireless signals at a fourth central frequency of about 2110 MHz. Furthermore, the current is also coupled from the sixth extending section 536 to the fourth radiation portion 54, and is grounded via the second ground portion 22. Thus, the fourth radiation portion 54 is activated to receive/transmit fifth wireless signals at a fifth central frequency of about 2330 MHz. FIG. 2 is a return loss (RL) graph of the antenna structure 100 of FIG. 1. The antenna structure 100 has good performance when operating at central frequencies of about 704-960 MHz and 1710-2690 MHz.

In summary, the first antenna 30 receives the current, and the current is coupled from the first antenna 30 to the second antenna 50. Additionally, the first radiation portion 51, the second radiation portion 52, the third radiation portion 53, and the fourth radiation portion 54 substantially form a loop structure to receive/transmit dual-band wireless signals or multiband wireless signals. Thus, the wireless communication device 200 does not require any additional antennas, which effectively reduces a required size of the wireless communication device 200.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An antenna structure, comprising:

a feed portion;

a first ground portion;

a second ground portion;

a first antenna comprising a first radiator and a second radiator connected to the first radiator, and a second antenna comprising a first radiation portion, a second radiation portion, a third radiation portion, and a fourth radiation portion, the first radiation portion, the second radiation portion, the third radiation portion, and the fourth radiation portion are connected in turn to substantially form a loop structure;

wherein both of the first radiator and the second radiator are connected to the feed portion, the first radiator is parallel to the first radiation portion, the second radiator is parallel to the second radiation portion, the first radiation portion is connected to the first ground portion, and the fourth radiation portion is connected to the second ground portion;

wherein the third radiation portion comprises a first extending section, a second extending section, a third extending section a fourth extending section, a fifth extending section, and a sixth extending section, the first extending section is connected to the second radiating portion, the second extending section is perpendicularly connected to the first extending section, the third extending section is perpendicularly connected between the second extending section and the fourth extending section, the fourth extending section and the second extending section are positioned parallel to each other and extend along two opposite directions to define a first gap, the fifth extending section is perpendicularly connected between the fourth extending section and the sixth extending section, the sixth extending section and the fourth extending section are positioned parallel to each other and extend along two opposite directions to define a second gap.

2. The antenna structure as claimed in claim 1, wherein the first radiator is a rectangular sheet, and extends towards the first ground portion.

3. The antenna structure as claimed in claim 1, wherein the second radiator is positioned coplanar with the first radiator, the second radiator comprises a first extending sheet and a second extending sheet, the first extending sheet is connected to the feed portion, and extends away from the first radiator, the second extending sheet is perpendicularly connected to the first extending sheet.

4. The antenna structure as claimed in claim 3, wherein the second radiation portion comprises a first sheet and a second sheet, the first sheet is connected to the first radiation portion, and is parallel to the first extending sheet, the second sheet is perpendicularly connected to the first sheet, and is parallel to the second extending sheet.

5. The antenna structure as claimed in claim 4, wherein the third radiation portion is positioned on a plane that is perpendicular to a plane in which the second radiation portion is positioned.

6. The antenna structure as claimed in claim 4, wherein the first extending section is connected to the second sheet.

7. The antenna structure as claimed in claim 6, wherein the fourth radiation portion comprises a first connection section, a second connection section, a third connection section, a fourth connection section, a fifth connection section, and a sixth connection section, the first connection section is connected to the sixth extending section, the second connection section is perpendicularly connected between the first connection section and the third connection section, and is parallel to the fifth extending section, a third gap is formed between the first connection section and the third connection section, the fourth connection section is perpendicularly connected between the third connection section and the fifth connection section, and is opposite to the third extending section, the fifth connection section and the third connection section are positioned parallel to each other and extend along two opposite directions to define a fourth gap, the sixth connection section is perpendicularly connected to the fifth connection section, and is parallel to the third extending section.

8. The antenna structure as claimed in claim 7, wherein the fourth radiation portion further comprises a seventh connection section and a eighth connection section, the seventh connection section is perpendicularly connected to the sixth connection section, and is coplanar with the first radiation portion, the eighth connection section extends towards the first radiation portion, and a distal end of the eight connection section is connected to the second ground portion.

9. A wireless communication device, comprising:

a printed circuit board (PCB)

an antenna structure located on the PCB, the antenna structure comprising:

a feed portion;

a first ground portion;

a second ground portion;

a first antenna, comprising a first radiator and a second radiator connected to the first radiator, and a second antenna, comprising a first radiation portion, a second radiation portion, a third radiation portion, and a fourth radiation portion, the first radiation portion, the second radiation portion, the third radiation portion, and the fourth radiation portion are connected in turn to substantially form a loop structure;

wherein both of the first radiator and the second radiator are connected to the feed portion, the first radiator is parallel to the first radiation portion, the second radiator is parallel to the second radiation portion, the first radiation portion is connected to the first ground portion, and fourth radiation portion is connected to the second ground portion;

wherein the third radiation portion comprises a first extending section, a second extending section, a third extending section a fourth extending section, a fifth extending section, and a sixth extending section, the first extending section is connected to the second radiating portion, the second extending section is perpendicularly connected to the first extending section, the third extending section is perpendicularly connected between the second extending section and the fourth extending section, the fourth extending section and the second extending section are positioned parallel to each other and extend along two opposite directions to define a first gap, the fifth extending section is perpendicularly connected between the fourth extending section and the sixth extending section, the sixth extending section and the fourth extending section are positioned parallel to each other and extend along two opposite directions to define a second gap.

10. The wireless communication device as claimed in claim 9, wherein the first radiator is a rectangular sheet, and extends towards the first ground portion.

11. The wireless communication device as claimed in claim 9, wherein the second radiator is positioned coplanar with the first radiator, the second radiator comprises a first extending sheet and a second extending sheet, the first extending sheet is connected to the feed portion, and extends away from the first radiator, the second extending sheet is perpendicularly connected to the first extending sheet.

12. The wireless communication device as claimed in claim 11, wherein the second radiation portion comprises a first sheet and a second sheet, the first sheet is connected to the first radiation portion, and is parallel to the first extending sheet, the second sheet is perpendicularly connected to the first sheet, and is parallel to the second extending sheet.

13. The wireless communication device as claimed in claim 12, wherein the third radiation portion is positioned on a plane that is perpendicular to a plane in which the second radiation portion is positioned.

14. The wireless communication device as claimed in claim 13, wherein the first extending section is connected to the second sheet.

15. The wireless communication device as claimed in claim 14, wherein the fourth radiation portion comprises a first connection section, a second connection section, a third connection section, a fourth connection section, a fifth connection section, and a sixth connection section, the first connection section is connected to the sixth extending section, the second connection section is perpendicularly connected between the first connection section and the third connection section, and is parallel to the fifth extending section, a third gap is formed between the first connection section and the third connection section, the fourth connection section is perpendicularly connected between the third connection section and the fifth connection section, and is opposite to the third extending section, the fifth connection section and the third connection section are positioned parallel to each other and extend along two opposite directions to define a fourth gap, the sixth connection section is perpendicularly connected to the fifth connection section, and is parallel to the third extending section.

16. The wireless communication device as claimed in claim 15, wherein the fourth radiation portion further comprises a seventh connection section and a eighth connection section, the seventh connection section is perpendicularly connected to the sixth connection section, and is coplanar with the first radiation portion, the eighth connection section extends towards the first radiation portion, and a distal end of the eight connection section is connected to the second ground portion.

17. The wireless communication device as claimed in claim 9, wherein the PCB has a feed pin, a first ground pin, and a second ground pin formed on the PCB, the feed portion is connected to the feed pin, the first ground portion is connected to the first ground pin, and the second ground portion is connected to the second ground pin.

* * * * *